US010883212B2

(12) United States Patent
Chang et al.

(10) Patent No.: US 10,883,212 B2
(45) Date of Patent: Jan. 5, 2021

(54) POSITION INDICATING CIRCUIT FOR A FOOT CONTROLLER OF A SEWING MACHINE, AND DETECTING SYSTEM USING THE SAME

(71) Applicant: Zeng Hsing Industrial Co., Ltd., Taichung (TW)

(72) Inventors: Wen-Fan Chang, Taichung (TW); Chia-Hui Yu, Taichung (TW)

(73) Assignee: ZENG HSING INDUSTRIAL CO., LTD., Taichung (TW)

( * ) Notice: Subject to any disclaimer, the term of this patent is extended or adjusted under 35 U.S.C. 154(b) by 202 days.

(21) Appl. No.: 16/265,019

(22) Filed: Feb. 1, 2019

(65) Prior Publication Data

US 2020/0248349 A1 Aug. 6, 2020

(51) Int. Cl.
*D05B 69/24* (2006.01)
*D05B 69/18* (2006.01)

(52) U.S. Cl.
CPC ..... *D05B 69/24* (2013.01); *D05B 69/18* (2013.01); *D05D 2205/04* (2013.01)

(58) Field of Classification Search
CPC ..... D05B 69/18; D05B 69/24; D05B 19/14; D05D 2205/04
See application file for complete search history.

(56) References Cited

U.S. PATENT DOCUMENTS 3,647,039 A * 3/1972 Oke ..... D05B 69/22 192/146
4,299,182 A * 11/1981 Tanaka ..... D05B 69/18 112/277
4,345,196 A * 8/1982 Hanyu ..... H02P 25/04 112/275
4,530,297 A * 7/1985 Fujikawa ..... D05B 69/18 112/275
4,577,576 A * 3/1986 Hanyu ..... D05B 19/00 112/277
4,586,448 A * 5/1986 Lerch ..... D05B 69/22 112/275
5,178,083 A * 1/1993 Duret ..... D05B 69/18 112/277
5,474,005 A * 12/1995 Yamauchi ..... D05B 69/22 112/275
2006/0021555 A1* 2/2006 Hamajima ..... D05B 69/18 112/217.3
2007/0256618 A1* 11/2007 Hamajima ..... H02P 27/024 112/277

* cited by examiner

*Primary Examiner* — Nathan E Durham
(74) *Attorney, Agent, or Firm* — Birch, Stewart, Kolasch & Birch, LLP

(57) ABSTRACT

A position indicating circuit includes: first and second input terminals for respectively receiving first and second voltages; an output terminal; a first resistor; and a second resistor having a first terminal coupled to the first input terminal through the first resistor, a second terminal coupled to the second input terminal, and a third terminal coupled to the output terminal. The second resistor is used to be actuated by a pedal of a foot controller of a sewing machine such that a voltage at the output terminal has a magnitude related to a position of the pedal. A detecting system that uses the position indicating circuit and that can determine whether the foot controller is coupled to a main body of the sewing machine is also provided.

12 Claims, 3 Drawing Sheets

POSITION INDICATING CIRCUIT FOR A FOOT CONTROLLER OF A SEWING MACHINE, AND DETECTING SYSTEM USING THE SAME

FIELD

The disclosure relates to a position indicating circuit and a detecting system, and more particularly to a position indicating circuit for a foot controller of a sewing machine and to a detecting system using the same.

BACKGROUND

A sewing machine available on the market generally includes a main body and a foot controller coupled to the main body. A user can depress a pedal of the foot controller to control some operations of the main body. When the user depresses the pedal and fails to obtain the desired control effect, the user cannot determine whether or not the foot controller is malfunctioned, as the foot controller may simply be uncoupled from the main body. However, checking the connection between the main body and the foot controller may be too troublesome, as it may be concealed inside the main body and require rigorous mechanical disassembling.

SUMMARY

Therefore, an object of the disclosure is to provide a position indicating circuit for a foot controller of a sewing machine, and to provide a detecting system that uses the position indicating circuit and that can determine whether or not the foot controller is coupled to a main body of the sewing machine.

According to an aspect of the disclosure, the position indicating circuit is used to be installed in a foot controller of a sewing machine. The foot controller includes a pedal. The position indicating circuit includes a first input terminal for receiving a first voltage, a second input terminal for receiving a second voltage, an output terminal, a first resistor and a second resistor. The first resistor has a first terminal that is coupled to the first input terminal, and a second terminal. The second resistor has a first terminal that is coupled to the second terminal of the first resistor, a second terminal that is coupled to the second input terminal, and a third terminal that is coupled to the output terminal. The second resistor is used to be actuated by the pedal such that at least one of a first resistance provided thereby between the first and third terminals thereof or a second resistance provided thereby between the second and third terminals thereof is variable according a position of the pedal, and such that a voltage at the output terminal has a magnitude related to the position of the pedal.

According to another aspect of the disclosure, there is provided the detecting system for a sewing machine. The sewing machine includes a main body, and a foot controller that includes a pedal. The detecting system includes a position indicating circuit and a detecting circuit. The position indicating circuit is used to be installed in the foot controller, and includes a first input terminal for receiving a first voltage, a second input terminal for receiving a second voltage, an output terminal, a first resistor and a second resistor. The first resistor has a first terminal that is coupled to the first input terminal, and a second terminal. The second resistor has a first terminal that is coupled to the second terminal of the first resistor, a second terminal that is coupled to the second input terminal, and a third terminal that is coupled to the output terminal. The second resistor is used to be actuated by the pedal such that at least one of a first resistance provided thereby between the first and third terminals thereof or a second resistance provided thereby between the second and third terminals thereof is variable according a position of the pedal, and such that a voltage at the output terminal has a magnitude related to the position of the pedal. The detecting circuit is used to be installed in the main body, and includes a detecting module and a determining module. The detecting module includes a third resistor and a fourth resistor. The third resistor has a first terminal that is for receiving a third voltage, and a second terminal that is capable of being coupled to the first input terminal of the position indicating circuit and that provides the first voltage. The fourth resistor has a first terminal that is for receiving the third voltage, and a second terminal that is capable of being coupled to the output terminal of the position indicating circuit. The detecting module generates a detection voltage with reference to a voltage at the second terminal of the fourth resistor. The determining module is coupled to the detecting module for receiving the detection voltage therefrom, and determines, based on the detection voltage, whether the position indicating circuit and the detecting circuit are coupled to each other.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
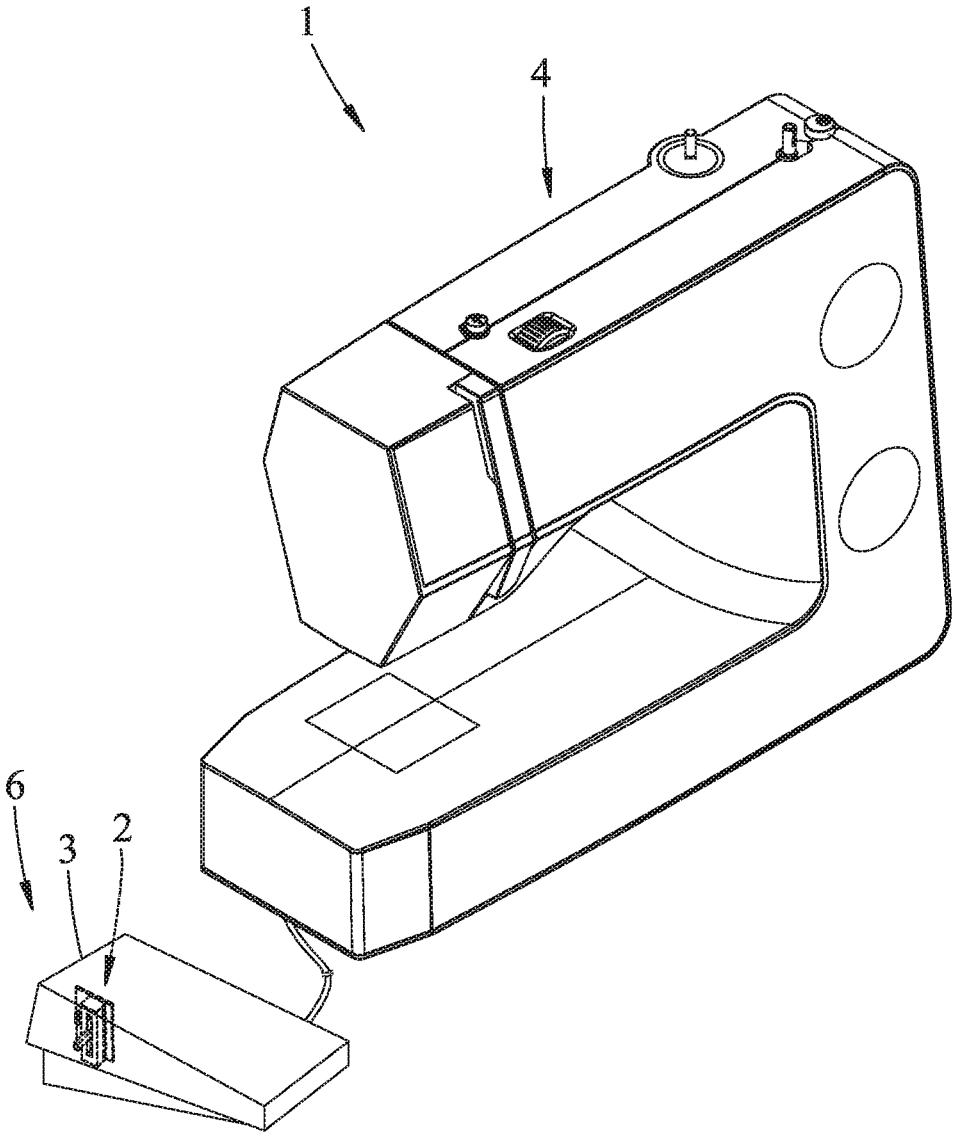
FIG. 1 is a structural diagram illustrating a use of an embodiment of a detecting system according to the disclosure in a sewing machine.
Figure 2:
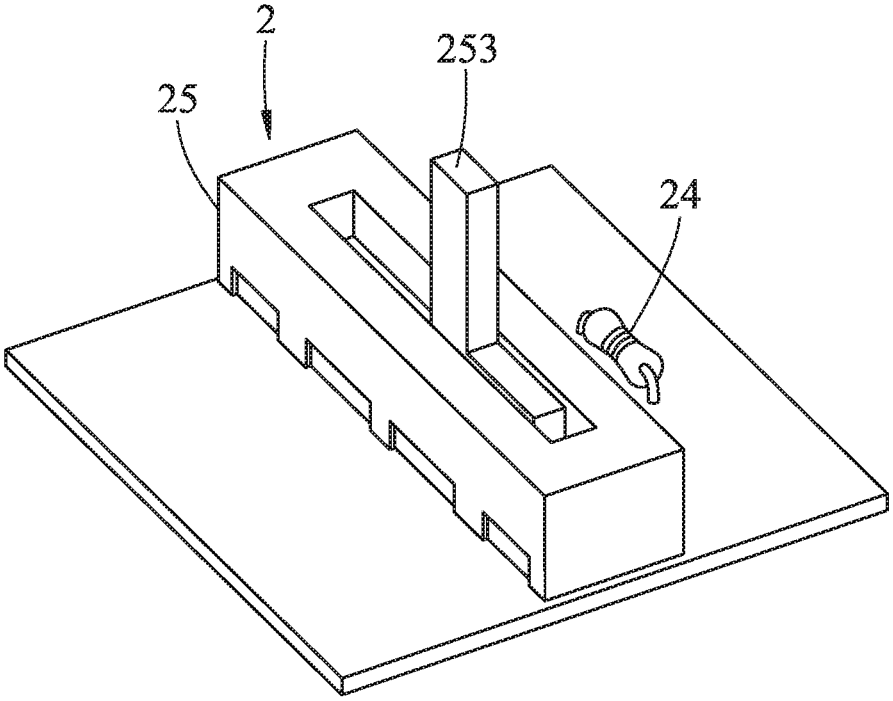
FIG. 2 is a structural diagram illustrating a position indicating circuit of the embodiment.
Figure 3:
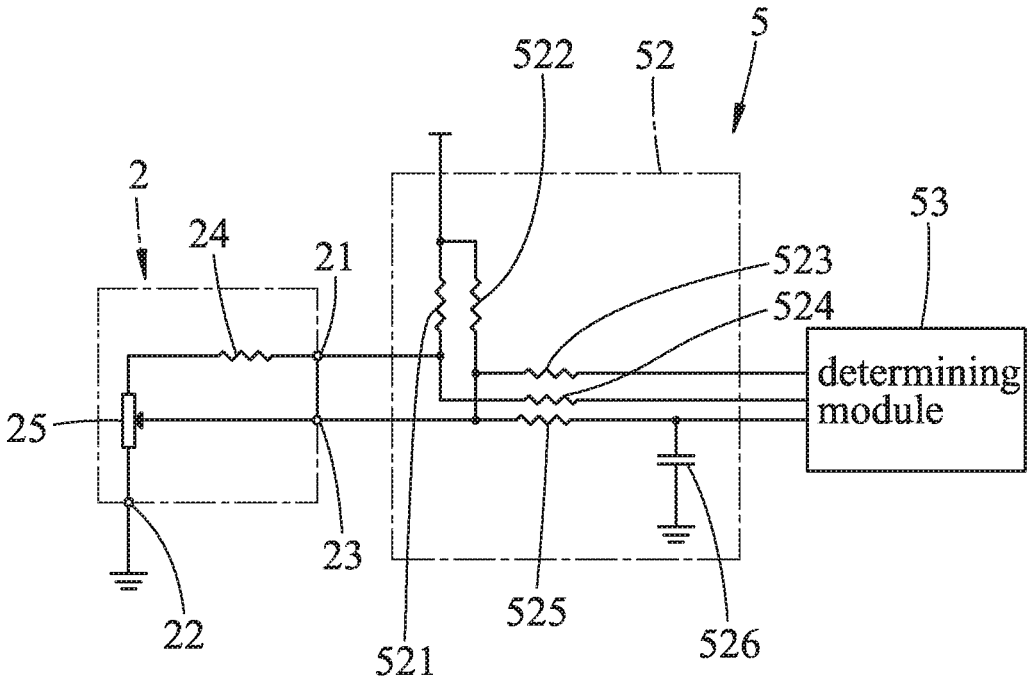
FIG. 3 is a circuit block diagram illustrating the embodiment.

Referring to FIGS. 1, 2 and 3, an embodiment of a detecting system according to the disclosure is used to be installed in a sewing machine 1. The sewing machine 1 includes a main body 4, and a foot controller 6 that includes a pedal 3. The pedal 3 can be depressed by a user in two different directions including a first direction (e.g., a forward direction) and a second direction (e.g., a backward direction). The detecting system of this embodiment includes a position indicating circuit 2 and a detecting circuit 5.

The position indicating circuit 2 is used to be installed in the foot controller 6, and includes a first input terminal 21 for receiving a first voltage, a second input terminal 22 for receiving a second voltage (e.g., a ground voltage), an output terminal 23, a first resistor 24 and a second resistor 25.

The first resistor 24 has a first terminal that is coupled to the first input terminal 21, and a second terminal.

The second resistor 25 has a first terminal that is coupled to the second terminal of the first resistor 24, a second terminal that is coupled to the second input terminal 22, and a third terminal that is coupled to the output terminal 23. The second resistor 25 is used to be actuated by the pedal 3 such that at least one of a first resistance provided thereby between the first and third terminals thereof or a second resistance provided thereby between the second and third terminals thereof is variable according a position of the pedal 3, and such that a voltage at the output terminal 23 has a magnitude related to the position of the pedal 3.

In this embodiment, the second resistor 25 includes a resistive element (not shown) and a wiper 253. The resistive element has two ends respectively coupled to the first and second terminals of the second resistor 25. The wiper 253 contacts the resistive element, is coupled to the third terminal of the second resistor 25, and is used to be actuated by the pedal 3 to slide along the resistive element. Therefore, a resistance provided by the second resistor 25 between the first and second terminals thereof is fixed, and is equal to a sum of the first and second resistances; and the first and second resistances change with the position of the pedal 3 even if a deviation of the position of the pedal 3 from an undepressed position of the pedal 3 is small. In addition, the first and second resistances vary linearly with the position of the pedal 3, and are non-zero when the pedal 3 is not depressed. In other words, the wiper 253 contacts an intermediate portion of the resistive element when the pedal 3 is not depressed. In an example, the first resistance is smaller than the second resistance (e.g., a ratio of the first resistance to the second resistance is 9:11) when the pedal 3 is not depressed. Moreover, when the pedal 3 is depressed in the first direction, the first resistance increases while the second resistance decreases, and when the pedal 3 is depressed in the second direction, the first resistance decreases while the second resistance increases.

The detecting circuit 5 is used to be installed in the main body 4, and includes a detecting module 52 and a determining module 53.

The detecting module 52 includes a third resistor 521 and a fourth resistor 522. The third resistor 521 has a first terminal that is for receiving a third voltage (e.g., 3.3V) greater than the second voltage in magnitude, and a second terminal that is capable of being coupled to the first input terminal 21 of the position indicating circuit 2 and that provides the first voltage. The fourth resistor 522 has a first terminal that is for receiving the third voltage, and a second terminal that is capable of being coupled to the output terminal 23 of the position indicating circuit 2. The detecting module 52 generates a detection voltage with reference to a voltage at the second terminal of the fourth resistor 522.

In this embodiment, the detecting module 52 further includes a fifth resistor 523, a sixth resistor 525, a capacitor 526 and a seventh resistor 524. The fifth resistor 523 has a first terminal that is coupled to the second terminal of the fourth resistor 522, and a second terminal. The sixth resistor 525 has a first terminal that is coupled to the second terminal of the fourth resistor 522, and a second terminal. The capacitor 526 is coupled between the second terminal of the sixth resistor 525 and ground. The seventh resistor 524 has a first terminal that is coupled to the second terminal of the third resistor 521, and a second terminal. A voltage at the second terminal of the fifth resistor 523 and a voltage at the second terminal of the sixth resistor 525 are substantially equal to the voltage at the second terminal of the fourth resistor 522 in magnitude, and one thereof serves as the detection voltage. A voltage at the second terminal of the seventh resistor 524 is substantially equal to the first voltage in magnitude.

When the second terminals of the third and fourth resistors 521, 522 are respectively coupled to the first input terminal 21 and the output terminal 23 of the position indicating circuit 2 (i.e., the main body 4 is coupled to the foot controller 6), the first voltage is smaller than the third voltage and greater than the second voltage in magnitude and the detection voltage is smaller than the first voltage and greater than or equal to the second voltage in magnitude because of voltage division performed by the first to fourth resistors 24, 25, 521, 522. When the second terminals of the third and fourth resistors 521, 522 are not coupled to the first input terminal 21 and the output terminal 23 of the position indicating circuit 2 (i.e., the main body 4 is not coupled to the foot controller 6), the first voltage and the detection voltage are substantially equal to the third voltage in magnitude.

It should be noted that respective resistances of the third and fourth resistors 521, 522 are selected depending on application requirements. In an example, the resistances of the third and fourth resistors 521, 522 are the same or approximate to each other, and do not cause the detection voltage to become too small in magnitude to be detected and analyzed when the second terminals of the third and fourth resistors 521, 522 are respectively coupled to the first input terminal 21 and the output terminal 23 of the position indicating circuit 2.

The determining module 53 is coupled to the second terminal of one of the fifth and sixth resistors 523, 525 for receiving the detection voltage therefrom, and determines, based on the detection voltage, whether the position indicating circuit 2 and the detecting circuit 5 are coupled to each other (i.e., whether the foot controller 6 and the main body 4 are coupled to each other).

In this embodiment, the determining module 53 is coupled further to the second terminal of the other one of the fifth and sixth resistors 523, 525 and the second terminal of the seventh resistor 524, and performs actions based on the voltages thereat. The feature of the disclosure does not reside in these actions of the determining module 53, and therefore details of the same are omitted herein for the sake of brevity.

In this embodiment, the determining module 53 determines that the position indicating circuit 2 and the detecting circuit 5 are not coupled to each other when the detection voltage has a magnitude greater than a predetermined first threshold value, and determines that the position indicating circuit 2 and the detecting circuit 5 are coupled to each other when the magnitude of the detection voltage is smaller than a predetermined second threshold value smaller than the first threshold value.

In addition, when the determining module 53 determines that the position indicating circuit 2 and the detecting circuit 5 are coupled to each other, the determining module 53 further determines, based on the detection voltage, whether the pedal 3 is not depressed, is depressed in the first direction, or is depressed in the second direction, and the deviation of the position of the pedal 3 from the undepressed position of the pedal 3. The determining module 53 determines that the pedal 3 is not depressed when the magnitude of the detection voltage is equal to a predetermined third threshold value smaller than the second threshold value, determines that the pedal 3 is depressed in the first direction when the magnitude of the detection voltage is smaller than the third threshold value, and determines that the pedal 3 is depressed in the second direction when the magnitude of the detection voltage is greater than the third threshold value.

It should be noted that the determining module 53 may be implemented using a microprocessor or a combination of logic cells. In addition, the main body 2 may include a warning module (not shown) (e.g., a display, a light emitting diode or a buzzer) that generates a warning (e.g., displaying a message, emitting light or making sound) to inform the user the disconnection between the foot controller 6 and the main body 4 when the determining module 53 determines that the position indicating circuit 2 and the detecting circuit 5 are not coupled to each other.

In view of the above, the detecting system of this embodiment has the following advantages.

1. The determining module 53 can determine, based on the detection voltage, whether the position indicating circuit 2 and the detecting circuit 5 are coupled to each other. Therefore, the main body 2 can generate a warning to inform the user the disconnection between the foot controller 6 and the main body 4 when the determining module 53 determines that the position indicating circuit 2 and the detecting circuit 5 are not coupled to each other, which is convenient for the user.

2. The first and second resistances change with the position of the pedal 3 even if the deviation of the position of the pedal 3 from the undepressed position of the pedal 3 is small. Therefore, when the position indicating circuit 2 and the detecting circuit 5 are coupled to each other, the determining module 53 can make determination based on the detection voltage even if the deviation of the position of the pedal 3 from the undepressed position of the pedal 3 is small, which prevents invalid depression of the pedal 3 and is convenient for the user.

3. The determining module 53 can determine the deviation of the position of the pedal 3 from the undepressed position of the pedal 3 when the position indicating circuit 2 and the detecting circuit 5 are coupled to each other. Therefore, the main body 2 can adjust a parameter thereof (e.g., a sewing speed) based on the deviation determined by the determining module 53, and the user can control the parameter of the main body 2 by depressing the pedal 3.

4. By virtue of the first and third resistors 21, 521, when the position indicating circuit 2 and the detecting circuit 5 are coupled to each other, a magnitude difference between the third voltage and the detection voltage is sufficiently large even if the pedal 3 is depressed in the second direction to its extremum, preventing the determining module 53 from erroneously determining that the position indicating circuit 2 and the detecting circuit 5 are not coupled to each other.

It should be noted that the first and second resistors 24, 25 may be resistors available on the market, instead of customized resistors, so as to decrease cost of the position indicating circuit 2. In addition, depending on application requirements, the second input terminal 22 of the position indicating circuit 2 may be coupled to ground in the position indicating circuit 2 or to ground in the detecting circuit 5.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A position indicating circuit used to be installed in a foot controller of a sewing machine, the foot controller including a pedal, said position indicating circuit comprising:

a first input terminal for receiving a first voltage;

a second input terminal for receiving a second voltage;

an output terminal;

a first resistor having a first terminal that is coupled to said first input terminal, and a second terminal; and a second resistor having a first terminal that is coupled to said second terminal of said first resistor, a second terminal that is coupled to said second input terminal, and a third terminal that is coupled to said output terminal, said second resistor being used to be actuated by the pedal such that at least one of a first resistance provided thereby between said first and third terminals thereof or a second resistance provided thereby between said second and third terminals thereof is variable according a position of the pedal, and such that a voltage at said output terminal has a magnitude related to the position of the pedal.

2. The position indicating circuit of claim 1, wherein the at least one of the first or second resistance varies linearly with the position of the pedal.

3. The position indicating circuit of claim 1, wherein the first voltage is greater than the second voltage in magnitude.

4. The position indicating circuit of claim 1, wherein the first and second resistances are non-zero when the pedal is not depressed.

5. A detecting system for a sewing machine, the sewing machine including a main body, and a foot controller that includes a pedal, said detecting system comprising:

a position indicating circuit used to be installed in the foot controller, and including a first input terminal for receiving a first voltage, a second input terminal for receiving a second voltage, an output terminal, a first resistor and a second resistor, said first resistor having a first terminal that is coupled to said first input terminal, and a second terminal, said second resistor having a first terminal that is coupled to said second terminal of said first resistor, a second terminal that is coupled to said second input terminal, and a third terminal that is coupled to said output terminal, said second resistor being used to be actuated by the pedal such that at least one of a first resistance provided thereby between said first and third terminals thereof or a second resistance provided thereby between said second and third terminals thereof is variable according a position of the pedal, and such that a voltage at said output terminal has a magnitude related to the position of the pedal; and a detecting circuit used to be installed in the main body, and including a detecting module and a determining module, said detecting module including a third resistor and a fourth resistor, said third resistor having a first terminal that is for receiving a third voltage, and a second terminal that is capable of being coupled to said first input terminal of said position indicating circuit and that provides the first voltage, said fourth resistor having a first terminal that is for receiving the third voltage, and a second terminal that is capable of being coupled to said output terminal of said position indicating circuit, said detecting module generating a detection voltage with reference to a voltage at said second terminal of said fourth resistor, said determining module being coupled to said detecting module for receiving the detection voltage therefrom, and determining, based on the detection voltage, whether said position indicating circuit and said detecting circuit are coupled to each other.

6. The detecting system of claim 5, wherein the at least one of the first or second resistance varies linearly with the position of the pedal.

7. The detecting system of claim 5, wherein the third voltage is greater than the second voltage in magnitude.

8. The detecting system of claim 7, wherein said determining module determines that said position indicating circuit and said detecting circuit are not coupled to each other when the detection voltage has a magnitude greater than a predetermined first threshold value, and determines that said position indicating circuit and said detecting circuit are coupled to each other when the magnitude of the detection voltage is smaller than a predetermined second threshold value smaller than the first threshold value.

9. The detecting system of claim 7, wherein, when said determining module determines that said position indicating circuit and said detecting circuit are coupled to each other, said determining module further determines, based on the detection voltage, whether the pedal is not depressed, is depressed in a first direction, or is depressed in a second direction different from the first direction, and a deviation of the position of the pedal from an undepressed position of the pedal.

10. The detecting system of claim 5, wherein the first and second resistances are non-zero when the pedal is not depressed.

11. The detecting system of claim 5, wherein said detecting module further includes a fifth resistor, said fifth resistor has a first terminal that is coupled to said second terminal of said fourth resistor, and a second terminal that is coupled to said determining module, and the detection voltage is provided at said second terminal of said fifth resistor.

12. The detecting system of claim 5, wherein said detecting module further includes a sixth resistor and a capacitor, said sixth resistor has a first terminal that is coupled to said second terminal of said fourth resistor, and a second terminal that is coupled to said determining module, said capacitor is coupled between said second terminal of said sixth resistor and ground, and the detection voltage is provided at said second terminal of said sixth resistor.

* * * * *